US007144317B1

(12) United States Patent
Marcuso

(10) Patent No.: US 7,144,317 B1
(45) Date of Patent: Dec. 5, 2006

(54) COIN SORTING MECHANISM USING CONTROLLED ANGULAR DEFLECTION

(76) Inventor: T. L. Marc Marcuso, 2358 Clifton Ave., Cincinnati, OH (US) 45219

( * ) Notice: Subject to any disclaimer, the term of this patent is extended or adjusted under 35 U.S.C. 154(b) by 0 days.

(21) Appl. No.: 11/119,028

(22) Filed: Apr. 29, 2005

(51) Int. Cl.
*G07D 3/00* (2006.01)
*G07D 3/04* (2006.01)
*G07D 3/12* (2006.01)

(52) U.S. Cl. ..... 453/3

(58) Field of Classification Search ..... 453/3, 453/4, 14, 15
See application file for complete search history.

(56) References Cited

U.S. PATENT DOCUMENTS 1,304,937 A 5/1919 Bozic
2,764,990 A * 10/1956 Pick ..... 453/5
4,263,924 A 4/1981 Johnson
4,396,029 A * 8/1983 Anderson ..... 453/15
4,995,848 A * 2/1991 Goh ..... 453/3
5,988,349 A 11/1999 Bruner et al.

* cited by examiner

*Primary Examiner*—Patrick Mackey
*Assistant Examiner*—Mark J. Beauchaine

(57) ABSTRACT

In the present sorting mechanism, coins of mixed denomination roll edgewise down an inclined channel toward a static coin deflector that contains a plurality of deflection-edges. These deflection-edges are distinctly curved and elevated at different predetermined distances above an extended surface. Coins of the smallest diameter roll underneath the deflector into a particular routing channel; coins of each larger diameter are selectively engaged by one of the deflection-edges and directed across this extended surface into their proper routing channel. The present mechanism implements a controlled form of diameter-dependent angular deflection which separates and routes a plurality of coin denominations in a space-efficient manner.

4 Claims, 9 Drawing Sheets

Fig. 6
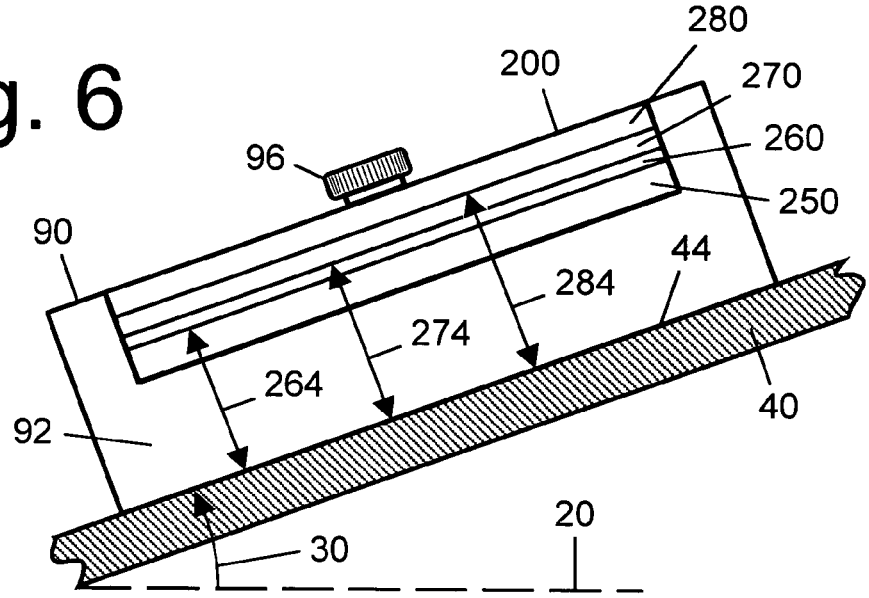
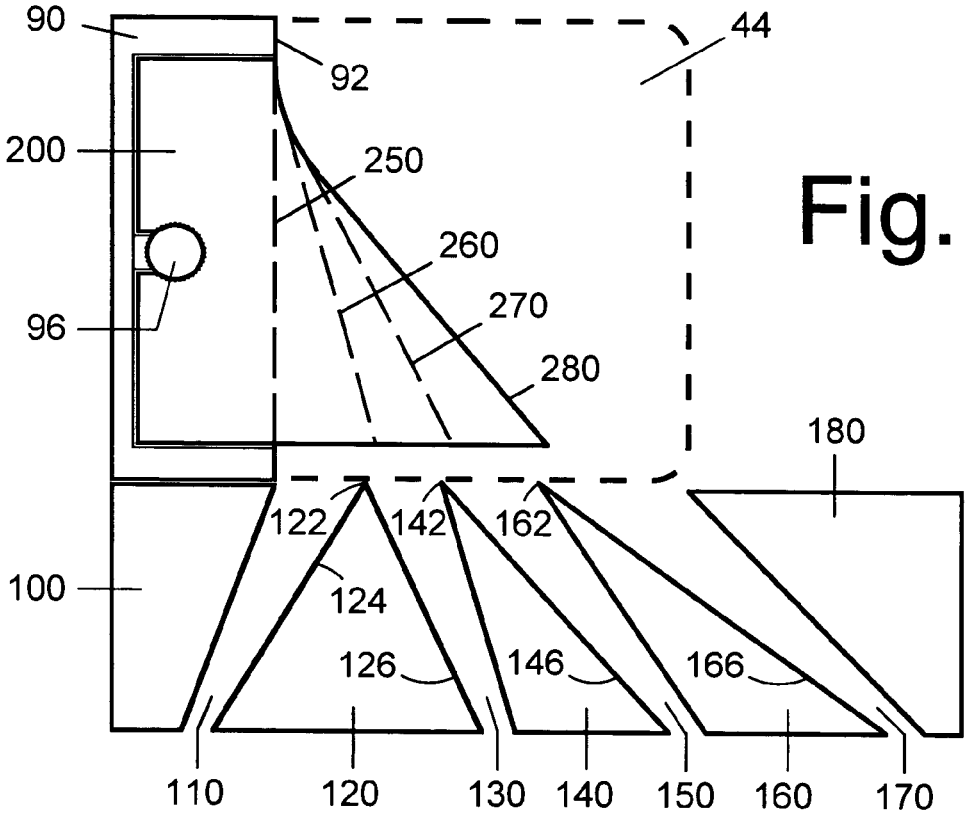
Fig. 7

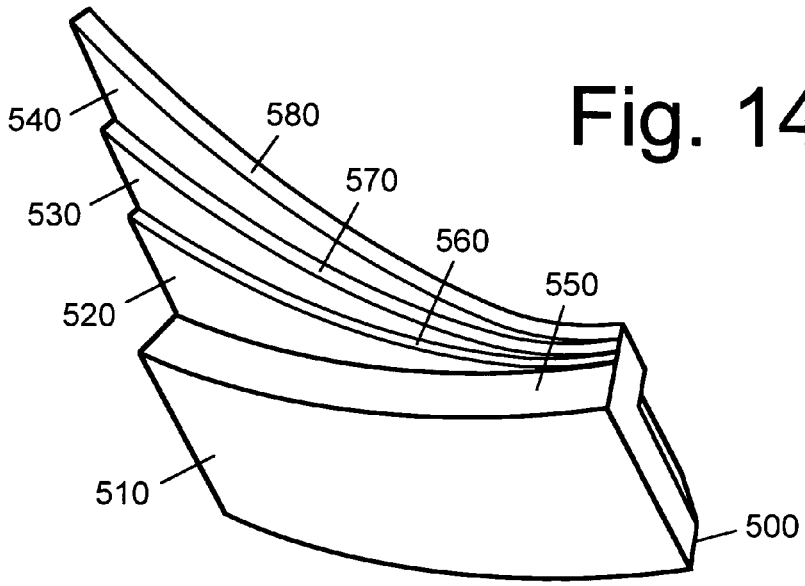
Fig. 14
Fig. 15
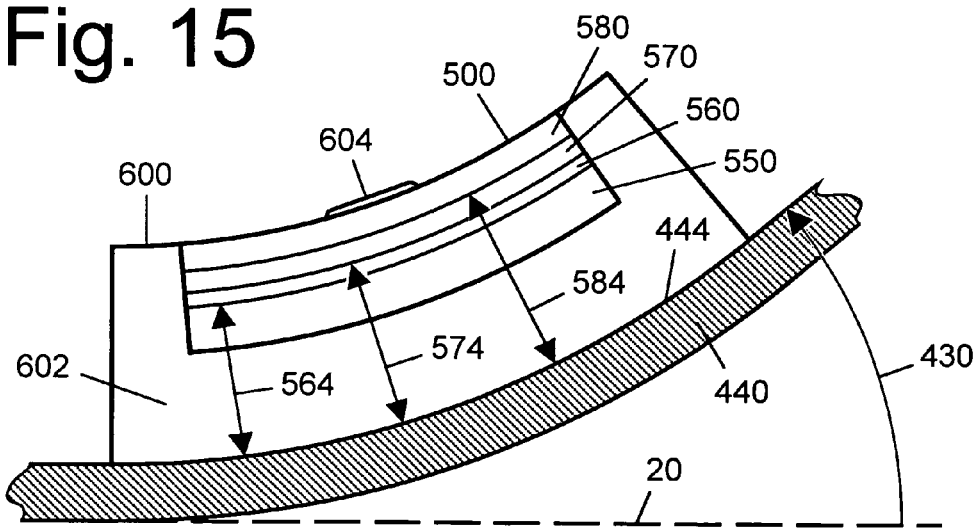

COIN SORTING MECHANISM USING CONTROLLED ANGULAR DEFLECTION

CROSS-REFERENCE TO RELATED APPLICATIONS

Not Applicable

FEDERALLY SPONSORED RESEARCH

Not Applicable

SEQUENCE LISTING OR COMPUTER PROGRAM

Not Applicable

BACKGROUND OF THE INVENTION (a) Field of Invention

The present invention relates to gravity-based sorting mechanisms which separate and route coins, and other disk-shaped objects, using diameter-dependent deflection.

(b) Discussion of Prior Art

Coin sorting mechanisms which operate by gravity and utilize diameter-dependent deflection are well-documented in U.S. patent literature—many descriptions date back to the late nineteenth century. Today, such gravity-based sorting mechanisms are commonly used in low-speed, cost-sensitive applications: coin validation systems represent one such application. Vending machines, and other coin-operated equipment, employ validation systems to verify the physical characteristics of deposited coins, and gravity-based sorting mechanisms generally provide the diameter-dependent separation and routing needed for this verification process.

U.S. Pat. No. 4,263,924 (R. A. Johnson, 1981) describes a gravity-based sorting mechanism designed for validation systems which separate and route multiple coin denominations. This sorting mechanism employs a hollow deflection element that pivots underneath a stationary block. The bottom portion of this stationary block contains a plurality of deflection-edges which are angled in different directions, and each deflection-edge is elevated at a different predetermined height above the floor of the hollow deflection element. Deposited coins of mixed denomination roll edgewise through the hollow deflection element, and coins of the smallest diameter roll underneath the stationary block into a particular routing channel. The deflection-edges of the stationary block selectively engage coins of each larger diameter and force the deflection element to pivot in different directions which guide these coins into their proper routing channel.

The sorting mechanism in U.S. Pat. No. 4,263,924 separates and routes a plurality of coin denominations in a very small amount of space, and this space-efficiency helps reduce the overall size of the validation system. Compact validation hardware is very important because the amount of space available inside coin-operated equipment tends to be rather limited. However, this space-efficiency is achieved through the use of a movable deflection element. Coin sorting mechanisms which utilize moving parts are expensive to manufacture and maintain; moving parts tend to wear quickly and must be cleaned and/or replaced on a regular basis to minimize the risk of mechanical failure. In these applications, such maintenance is critically important because mechanical failure can translate into lost revenue.

U.S. Pat. No. 5,988,349 (Bruner et al., 1999) describes a coin validation system which separates and routes multiple coin denominations using static deflection elements, and the elimination of moving parts reduces the manufacturing and maintenance costs of the hardware. But, each static deflection element separates and routes coins with respect to only one predetermined diameter at a time; so, multiple deflection elements must be networked together in order to process a plurality of coin denominations, and this tends to increase the overall size and complexity of the validation system.

SUMMARY OF THE INVENTION

The present invention represents a gravity-based coin sorting mechanism which separates and routes a plurality of coin denominations using a controlled form of diameter-dependent angular deflection. This approach produces a compact sorting device that can be manufactured using cost-efficient methods. Other advantages will become apparent from the information presented in the ensuing description and drawings.

DESCRIPTION OF DRAWINGS

FIG. 6 is a side elevation view of the deflector and mounting-block that illustrates the proper alignment of the deflector with respect to the planar deflection-area.

FIG. 7 is a top plan view of the deflector and mounting-block that illustrates the proper alignment of the deflector with respect to the various exit channels.

FIG. 14 is a perspective view of the lower surfaces of the coin deflector shown in FIG. 13.

FIG. 15 is a side elevation view of the deflector and mounting-block shown in FIG. 13; this figure illustrates the proper alignment of the deflector with respect to the cylindrical deflection-area.

DETAILED DESCRIPTION OF THE INVENTION

(a) Preferred Embodiment

FIGS. 1–9

Figure 1:
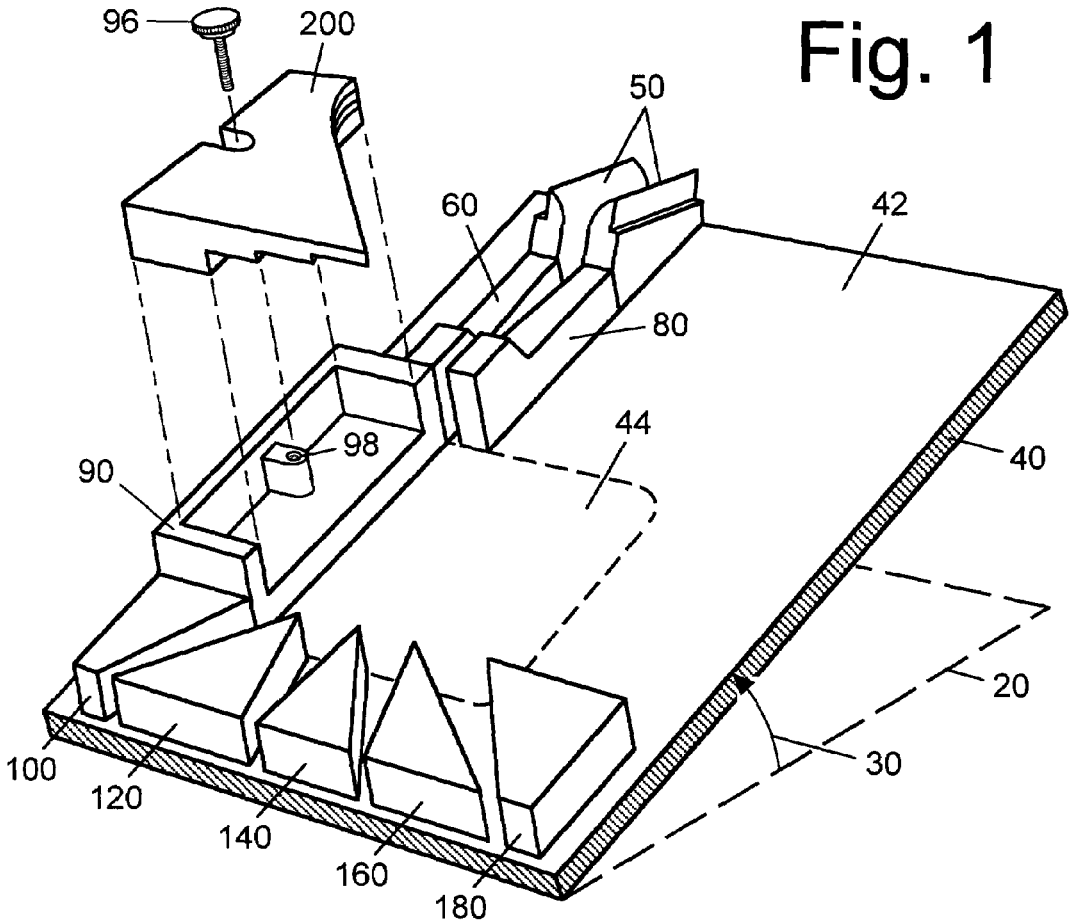
FIG. 1 is a perspective view of the preferred embodiment of the present coin sorting mechanism in which coin separation occurs across a planar deflection-area.

FIG. 1 shows a perspective view of the preferred embodiment of the present sorting mechanism. Base 40 has an upper surface 42 that is horizontally level in the lateral direction (side-to-side) and inclined longitudinally (top-to-bottom) at a predetermined angle 30 relative to the horizontal plane 20. The spatial orientation of surface 42 is maintained by a means of support (not shown) attached to base 40; this means of support is not part of the present invention.

Structural components that extend upward from surface 42 include: coin-chute 50, deflection-wall 60, collimation-wall 80, mounting-block 90, and routing structures 100, 120, 140, 160, 180. Deflection-area 44 represents a portion of surface 42 which extends away from mounting-block 90 in the lateral direction. Deflector 200 is a removable element, and mounting-block 90 is designed to hold deflector 200 in proper operational alignment with respect to deflection-area 44 and various structural components distributed across surface 42. In the present embodiment, deflector 200 is installed inside a depression in the upper portion of mounting-block 90 by means of thumbscrew 96 which threads into hole 98. In general, the specific number of routing structures, and some of the physical features of deflector 200, depend on the number of coin denominations being sorted. In the form described here, the present sorting mechanism is capable of separating and routing four coin denominations.

Figure 2:
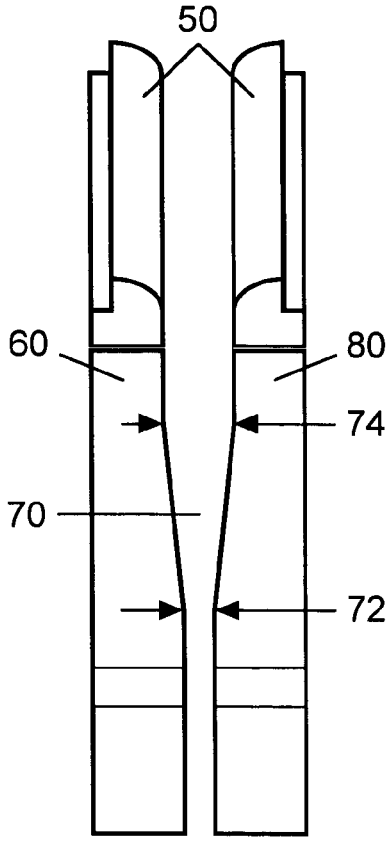
FIGS. 2 and 3 are respectively a top plan view and perspective view of the deflection-wall and collimation-wall; these figures show the variation in the width and height of the input channel.
Figure 3:
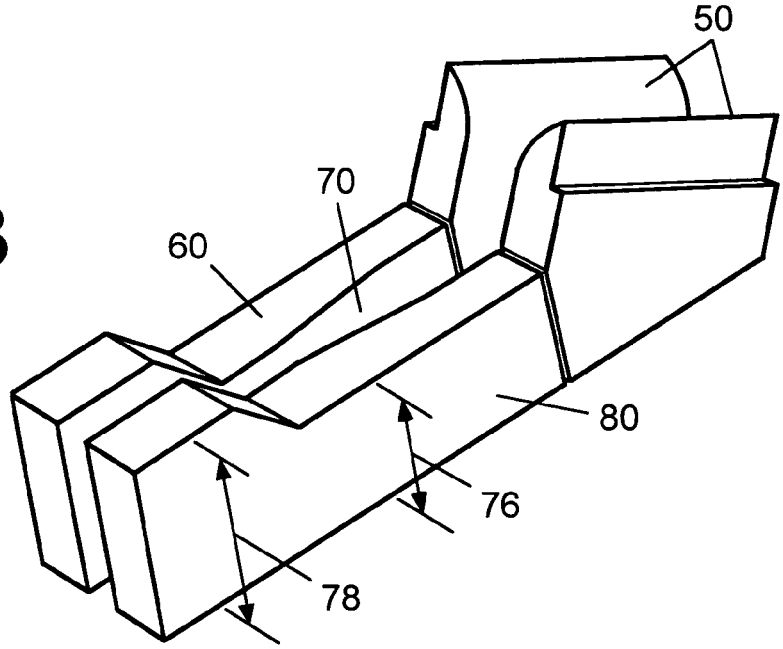

FIGS. 2 and 3 provide a top plan view and perspective view of coin-chute 50, deflection-wall 60, and collimation-wall 80. In FIG. 2, the space between deflection-wall 60 and collimation-wall 80 defines input channel 70. The width of input channel 70 is nonuniform. The minimum lateral separation between the sidewalls of coin-chute 50 equals the maximum width 74 of input channel 70. Starting at a small distance downstream from coin-chute 50, the width of input channel 70 gradually decreases and reaches a minimum value 72 at a small distance upstream from the bottom ends of deflection-wall 60 and collimation-wall 80. Minimum width 72 has a predetermined value which is slightly greater than the largest coin-thickness in the set of denominations being sorted. Maximum width 74 is approximately twice the predetermined value of minimum width 72.

As shown in FIG. 3, the height of input channel 70 is also nonuniform. Starting at the bottom end of coin-chute 50, input channel 70 has a predetermined minimum height 76 which is less than the smallest coin-diameter in the set of denominations being sorted. The height of input channel 70 increases to a predetermined maximum value 78 at a small distance upstream from the bottom ends of deflection-wall 60 and collimation-wall 80. Maximum height 78 is slightly greater than the largest coin-diameter in the set of denominations being sorted. The constriction in the width of input channel 70 occurs within the interval where input channel 70 has its minimum height 76.

Figure 4:
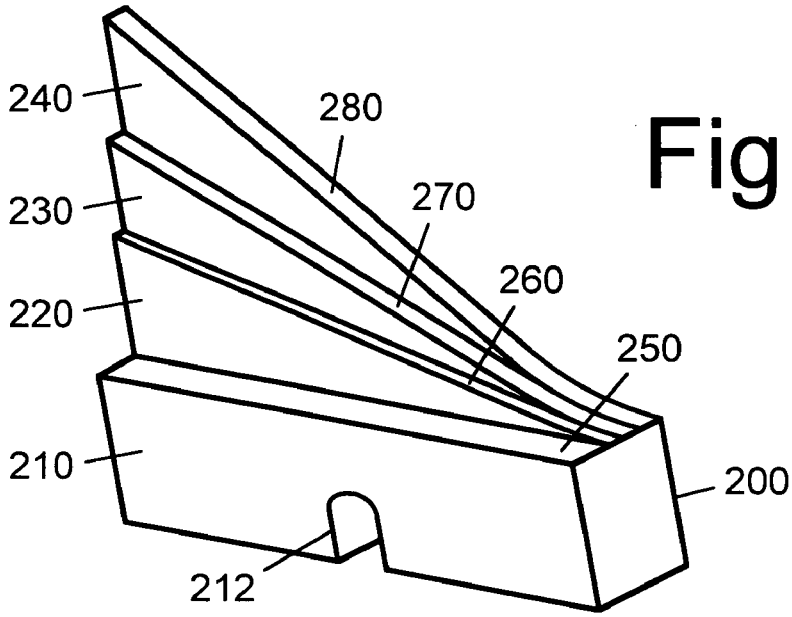
FIG. 4 is a perspective view of the lower surfaces of the coin deflector.

FIG. 4 shows a perspective view of the lower surfaces of deflector 200. These lower surfaces include: mounting-surface 210, undersurfaces 220, 230, 240, front mounting-edge 250, and deflection-edges 260, 270, 280. Open-slot 212 facilitates the installation and removal of deflector 200 from mounting-block 90. Mounting-surface 210 and undersurfaces 220, 230, 240 are mutually parallel, and these surfaces are perpendicular to mounting-edge 250 and deflection-edges 260, 270, 280. Each deflection-edge consists of a circular-section located near the top of deflector 200 and a straight-section located toward the bottom. At the top of deflector 200, each circular-section curves tangentially away from the plane of front mounting-edge 250 and subtends a different predetermined angle with respect to this plane.

Figure 5:
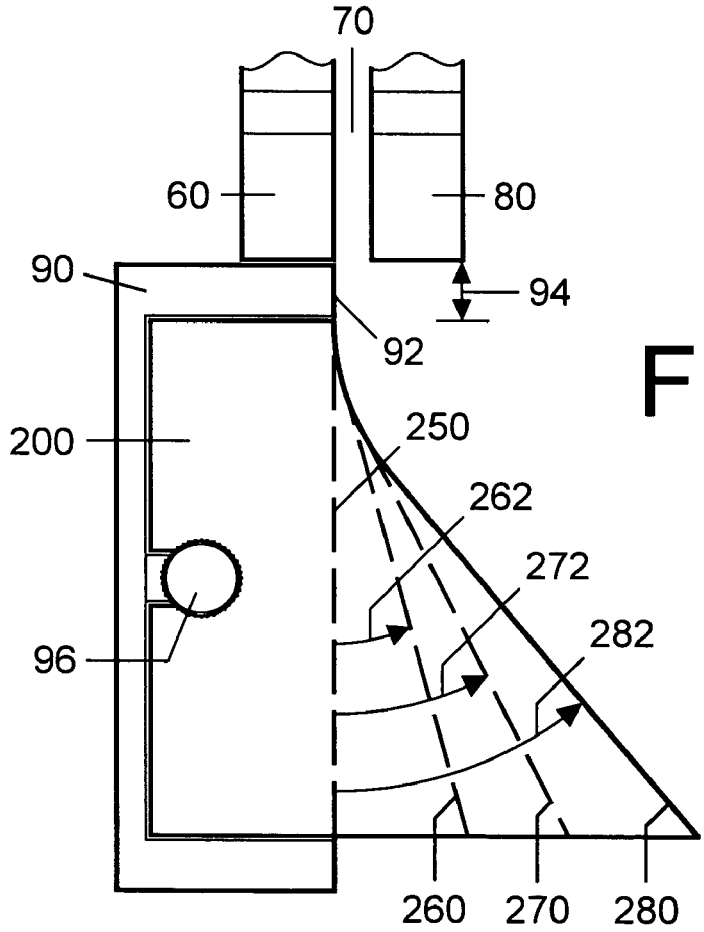
FIG. 5 is a top plan view of the deflector and mounting-block that illustrates the proper alignment of the deflector with respect to the bottom end of the input channel.

FIG. 5 provides a top plan view of deflector 200 installed in mounting-block 90 and includes the bottom portion of input channel 70; a side elevation view of deflector 200 installed in mounting-block 90 is shown in FIG. 6. In FIG. 5, front-surface 92 of mounting-block 90 is laterally aligned with the inner-surface of deflection-wall 60 at the bottom of input channel 70. Deflector 200 is offset downstream from the bottom end of input channel 70 by a small distance 94. Distance 94 provides a "turning-clearance" for coins to roll edgewise down and laterally away from the bottom end of input channel 70 without becoming lodged against the inner-surface of collimation-wall 80. In the proper alignment of deflector 200, front mounting-edge 250 is laterally aligned with front-surface 92 of mounting-block 90, and, as shown in FIG. 6, deflection-edges 260, 270, 280 are parallel to deflection-area 44 at predetermined heights 264, 274, 284, respectively.

The predetermined values of heights 264, 274, 284 depend on the diameters of the coin denominations being sorted. Height 264 is greater than the smallest diameter, but less than the second-smallest diameter; height 274 is greater than the second-smallest diameter, but less than the second-largest diameter, and height 284 is greater than the second-largest diameter, but less than the largest diameter. As viewed in FIG. 5, the straight-sections of deflection-edges 260, 270, 280 diverge away from the common plane of front-surface 92 and front mounting-edge 250 at predetermined angles 262, 272, 282, respectively. The magnitudes of angles 262, 272, 282 are ordered with respect to the magnitudes of heights 264, 274, 284. That is, deflection-edge 260 has the smallest height 264 and the smallest angle 262; deflection-edge 270 has intermediate height 274 and intermediate angle 272, and deflection-edge 280 has the largest height 284 and the largest angle 282.

FIG. 7 shows a top plan view of routing structures 100, 120, 140, 160, 180 with deflector 200 installed in mounting-block 90. The space between each adjacent pair of routing structures 100, 120, 140, 160, 180 defines exit channels 110, 130, 150, 170, respectively. The heights of exit channels 110, 130, 150, 170 are equal to a common predetermined value which is less than the smallest coin-diameter in the set of denominations being sorted. In the proper alignment of deflector 200, as viewed in FIG. 7, vertex 122 of routing structure 120 is displaced slightly down and to the left of the bottom end of deflection-edge 260. Similarly, vertex 142 of routing structure 140, and vertex 162 of routing structure 160 are displaced slightly down and to the left of the bottom ends of deflection-edges 270 and 280, respectively. Surface 124 of routing structure 120 is angled clockwise relative to the longitudinal direction, and surface 126 is angled slightly counterclockwise relative to the straight-section of deflection-edge 260. Surface 146 of routing structure 140 is angled slightly counterclockwise relative to the straight-section of deflection-edge 270, and surface 166 of routing structure 160 is angled slightly counterclockwise relative to the straight-section of deflection-edge 280.

Figure 8:
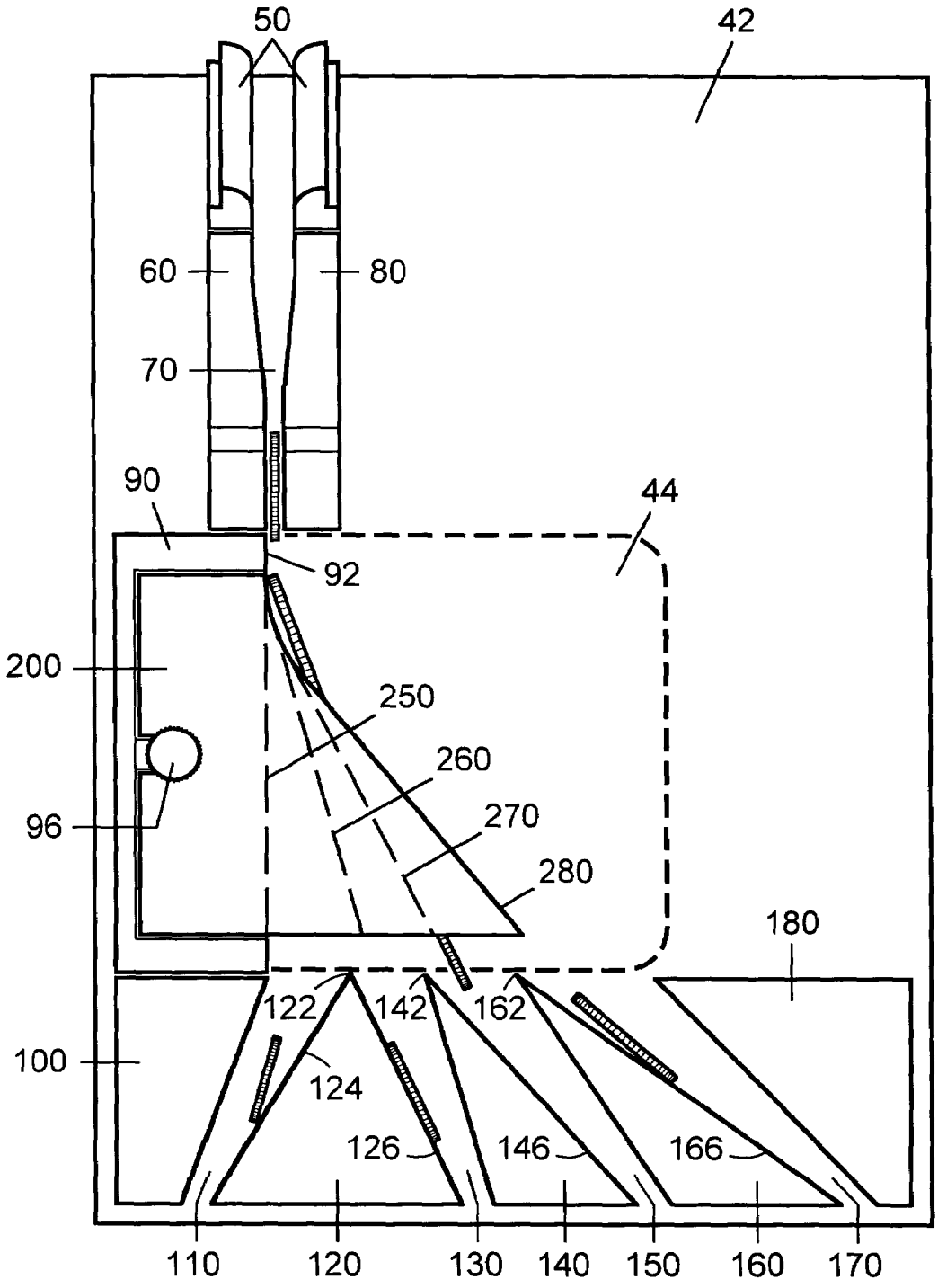
FIG. 8 is a top plan view of the coin sorting mechanism that illustrates the movement of coins through the mechanism during normal operation.

In normal operation, as illustrated in the top plan view of FIG. 8, coins of mixed denomination enter coin-chute 50 one at a time and roll edgewise down input channel 70 toward deflector 200. As the coins approach deflector 200, the increased height and reduced width at the bottom of input channel 70 forces the coins to roll in a vertical orientation, and the reduced width also insures that the coins emerge from input channel 70 in single file.

The smallest-sized coins have diameters which are less than height 264, so these coins roll underneath deflector 200 and are collected into exit channel 110 by surface 124 of routing structure 120. The diameters of the second smallest-sized coins are greater than height 264, but less than height 274. Deflection-edge 260 engages the top portions of these coins and directs their rolling motion toward surface 126 of routing structure 120; surface 126 collects these coins into exit channel 130. The diameters of the second largest-sized coins are greater than height 274, but less than height 284. Deflection-edge 270 engages the top portions of these coins and directs their rolling motion toward surface 146 of routing structure 140; surface 146 collects these coins into exit channel 150. The diameters of largest-sized coins are greater than height 284, so deflection-edge 280 engages the top portion of these coins and directs their rolling motion toward surface 166 of routing structure 160; surface 166 collects these coins into exit channel 170.

In some operational environments, coins may not always enter coin-chute 50 one at a time. For example, if the present mechanism is operated manually, coins can be inadvertently dropped into coin-chute 50 too quickly. Coin-chute 50 and the maximum width at the top of input channel 70 are designed to allow two coins in a side-by-side configuration to roll downward, away from coin-chute 50; this prevents such coins from becoming lodged within coin-chute 50—a location which is rather difficult to access. The constriction in the width of input channel 70 arrests such coins at a location where they can be accessed more easily—namely, where input channel 70 has its minimum height.

In general, small variations in the spatial orientation of surface 42 do not affect the normal operation of the present mechanism. For instance, a small change in inclination angle 30 of surface 42 just increases or decreases the overall rate at which coins move through the mechanism. If surface 42 is tilted slightly to the left—that is, if the left side of surface 42 is slightly lower than the right side—the vertical orientations of the coins will be biased to the left as they emerge from the bottom of input channel 70. Since the motions of the three larger-sized coins are controlled by deflection-edges 260, 270, 280, the trajectories of these coins toward exit channels 130, 150, 170 will not change significantly. The motion of the smallest-sized coins will be biased to the left, so these coins will be guided into exit channel 110 by front-surface 92 of mounting-block 90. If surface 42 is tilted slightly to the right, the motion of the three larger-sized coins will again remain largely unaffected, but the trajectories of the smallest-sized coins will drift to the right. By positioning vertex 122 as far right as possible—namely, just down and to the left of the bottom end of deflection-edge 260—surface 124 of routing structure 120 can still collect the smallest-sized coins into exit channel 110.

Figure 9:
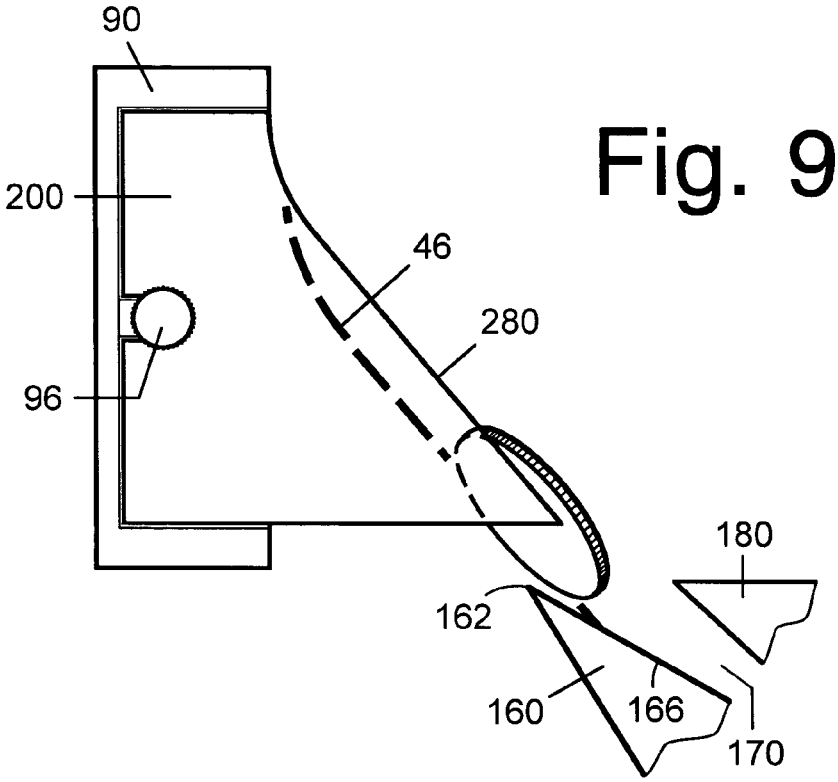
FIG. 9 is a top plan view of a coin emerging from the deflector in a tilted orientation and rolling edgewise into its respective exit channel.

As viewed in FIGS. 7 and 8, vertices 122, 142, 162 are respectively positioned down and to the left of the bottom ends of deflection-edges 260, 270, 280 in order to accommodate the bottom portions of the three larger-sized coins as they emerge from deflector 200. During the deflection process, deflection-edges 260, 270, 280 exert contact forces on the top portions of the three larger-sized coins, so these coins tend to roll toward exit channels 130, 150, 170 in tilted orientations. For example, FIG. 9 shows a top plan view of one of the largest-sized coins as it emerges from deflection-edge 280 and rolls toward exit channel 170 in such a tilted orientation. Dashed-line 46 represents the trajectory of the bottom portion of the coin across deflection-area 44. Toward the end of the deflection process, as viewed in FIG. 9, the trajectory of the bottom portion of the coin becomes approximately parallel to deflection-edge 280, but it is offset slightly down and to the left. Vertex 162 of routing structure 160 is displaced slightly down and to the left of the bottom end of deflection-edge 280 to provide proper clearance for such trajectories. Vertices 122, 142 provide the same type of clearance for the other two larger-sized coins.

Friction plays an important role during the deflection process because deflection-area 44 must provide sufficient traction to keep the three larger-sized coins from slipping underneath deflector 200. The maximum amount of friction available from deflection-area 44 can be increased by reducing inclination angle 30 of surface 42, but this slows down the overall movement of the coins through the mechanism. In order to insure adequate traction for the deflection process without compromising throughput performance, surface 42 can be textured or coated to increase the friction within deflection-area 44, or base 40 can be fabricated from a material that has a high coefficient of friction.

Friction is also an important factor with regard to the design changes needed to sort a different number of coin denominations. The maximum amount of friction available from the deflection-area establishes a maximum angle for reliable coin deflection. So, in general, increasing the number of coin denominations involves using a larger number of deflection-edges with straight-sections that diverge with smaller angular increments. But, in order to accommodate the width of each exit channel, the lateral separation between each deflection-edge at the bottom of the deflector must remain unchanged; so, reducing the angular separation between the straight-sections of adjacent deflection-edges increases the length of the deflector in the longitudinal direction. The width along the bottom edge of the deflector must also be increased to accommodate a larger number of exit channels. Therefore, sorting a larger number of coin denominations generally increases the overall size of the deflector in both the longitudinal and lateral directions. Conversely, sorting a smaller number of coin denominations generally decreases the overall size of the deflector in both the longitudinal and lateral directions.

The present mechanism offers considerable flexibility with regard to general construction, and this flexibility can be used to control the amount of friction that exists at different locations. That is, increasing the friction between the coins and the deflection-area improves the reliability of the deflection process, but decreasing the friction between the coins and various surfaces of the structural components improves durability and throughput performance. These design goals can be resolved by fabricating the base and structural components separately out of different materials. The optimization of the reliability and durability of the present mechanism can be particularly important in certain applications. However, in other cases, it may be more cost-effective to fabricate the base and structural components as one integral part—injection-molded, for instance—using a common material. This type of construction would significantly reduce the manufacturing and assembly costs in applications that require large-volume production. The removable deflector can be fabricated out of a durable, low-friction material.

(b) Alternative Embodiments

FIGS. 10–15

Figure 10:
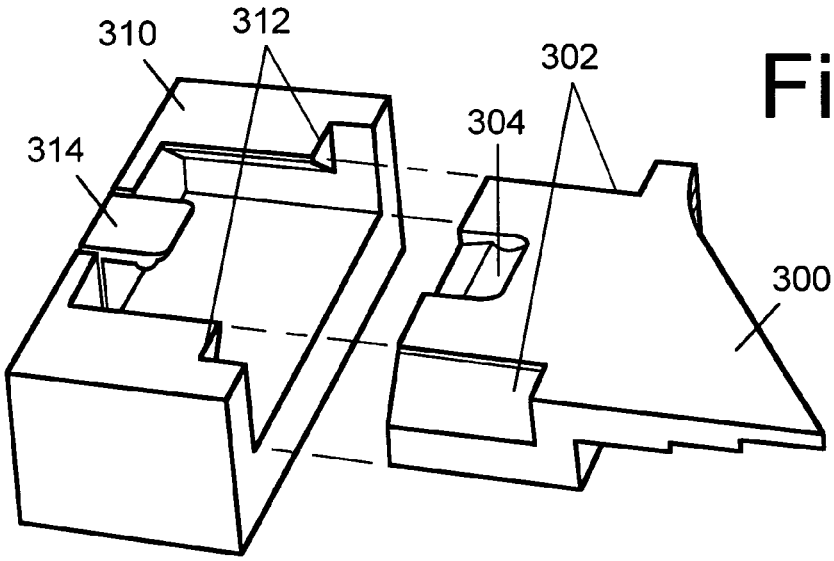
FIGS. 10, 11, 12 are perspective views of alternative embodiments of the deflector and mounting-block; these figures illustrate three different installation methods for the deflector.
Figure 11:
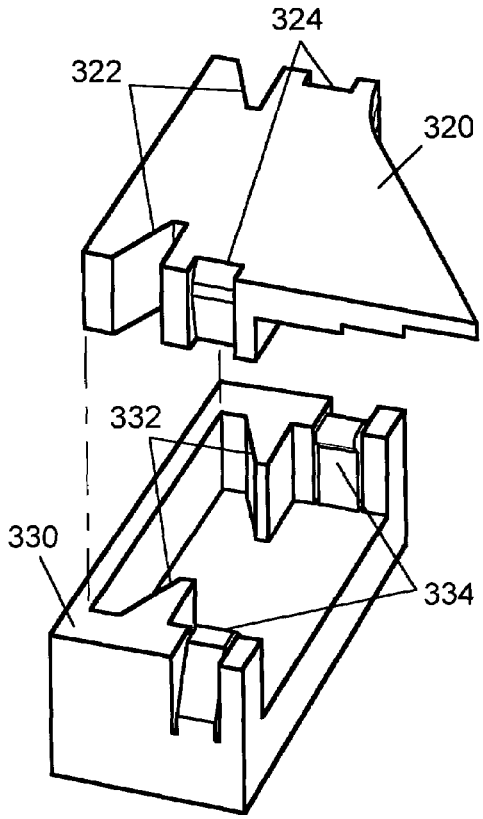
Figure 12:
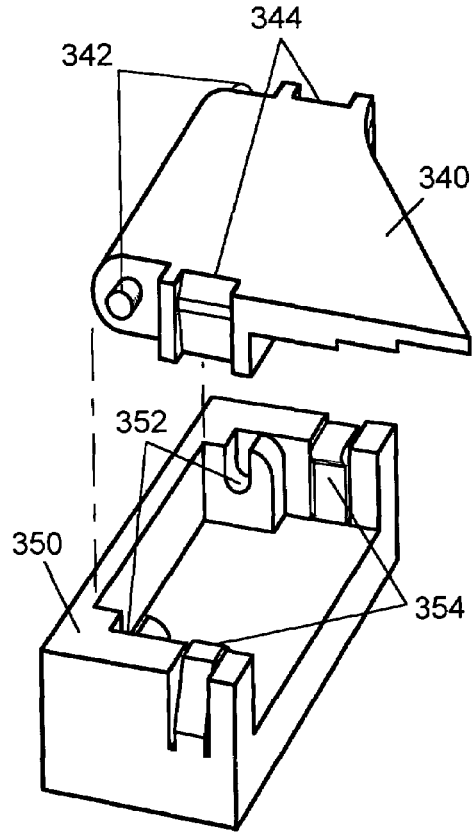

Different operational environments may require different methods for installing the deflector into the mounting-block. In some applications—due to space limitations, for instance—the deflector may have to be installed in the lateral direction; in other cases, the installation may have to be carried out in the vertical direction. Different methods can be employed to hold the deflector in proper operational alignment without the use of separate fasteners. Some alternative installation methods are illustrated in FIGS. 10, 11, and 12. However, in general, many other installation methods are possible.

FIG. 10 shows an example of a lateral installation method which utilizes a dovetail-joint formed by horizontal-flanges 312 in mounting-block 310 and beveled-edges 302 in the rear portion of deflector 300. The proper alignment of deflector 300 is maintained by a flexible clamp 314 which latches into the tapered surface of indentation 304. FIG. 11 illustrates a vertical installation method in which deflector 320 is inserted down into a depression in mounting-block 330; this depression contains vertical-flanges 332 that form a dovetail-joint with beveled-slots 322 in deflector 320. Deflector 320 is held against the bottom of the depression by two flexible clamps 334 which independently latch into the tapered surfaces of indentations 324. FIG. 12 shows another vertical installation method. In this case, when deflector 340 is inserted down into the depression of mounting-block 350, pivot-pins 342 in the rear portion of deflector 340 slide into open-slots 352 in mounting-block 350 and create a hinged-joint which enables deflector 340 to be rotated downward against the bottom of the depression. In the same manner as before, the proper alignment of deflector 340 is maintained by two flexible clamps 354 which independently latch into the tapered surfaces of indentations 344.

In the preferred embodiment of the present sorting mechanism, coin separation occurs across a planar surface; however, coin separation can also occur across a curved surface. For example, FIG. 13 shows a perspective view of an alternative embodiment of the present sorting mechanism which uses a cylindrical deflection-area.

Figure 13:
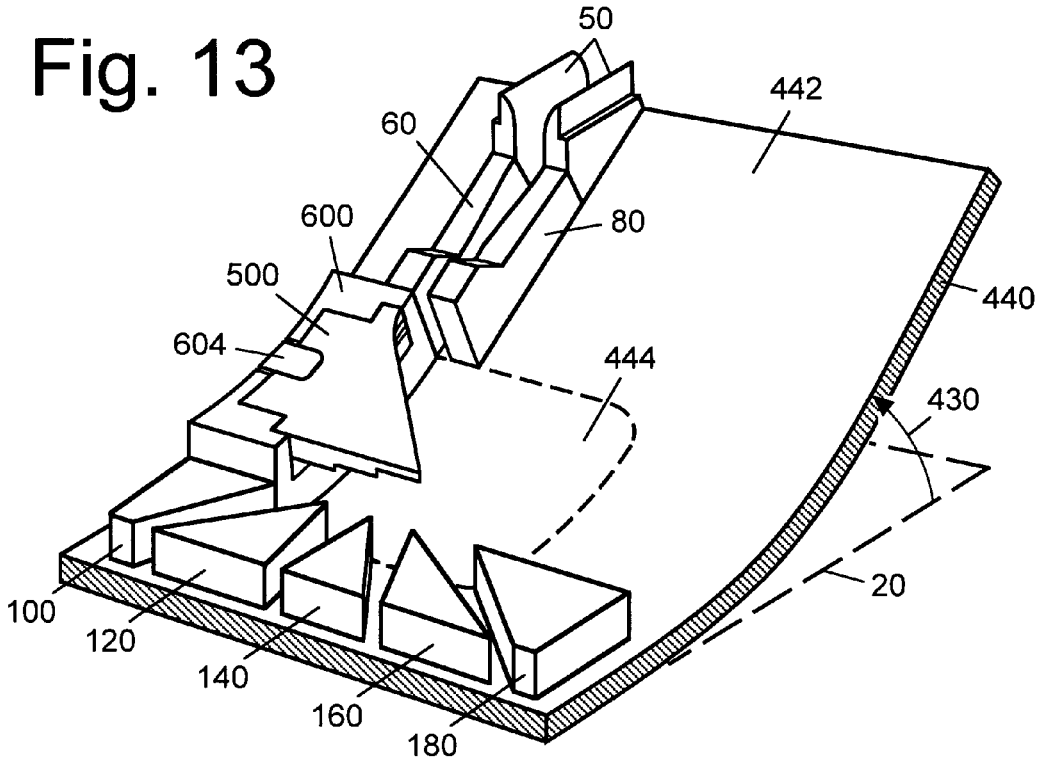
FIG. 13 is a perspective view of an alternative embodiment of the present coin sorting mechanism in which coin separation occurs across a cylindrical deflection-area.

In FIG. 13, surface 442 of base 440 is planar above and below deflection-area 444. The planar portion of surface 442 below deflection-area 444 is horizontally level in the lateral and longitudinal directions. The planar portion of surface 442 above deflection-area 444 is horizontally level in the lateral direction, but longitudinally inclined at a predetermined angle 430 relative to the horizontal plane 20. The middle portion of surface 442 is curved so that deflection-area 444 conforms to the surface of a circular cylinder. Coin-chute 50, deflection-wall 60, collimation-wall 80, and routing structures 100, 120, 140, 160, 180 are the same structural components utilized in the preferred embodiment of the present mechanism. In this embodiment, deflector 500 is installed in mounting-block 600 using the method illustrated in FIG. 10—that is, using a horizontal dovetail-joint, secured by flexible clamp 604.

FIG. 14 shows a perspective view of the lower surfaces of deflector 500. Mounting-surface 510 and undersurfaces 520, 530, 540 are curved to accommodate the cylindrical shape of deflection-area 444; that is, these surfaces are curved to form surface elements of circular cylinders. Mounting-surface 510 and undersurfaces 520, 530, 540 are concentrically aligned along a common central axis and have different predetermined radii with respect to this common axis; these surfaces are perpendicular to front mounting-edge 550 and deflection-edges 560, 570, 580. Each deflection-edge curves tangentially away from the plane of mounting-edge 550, then extends away from this plane in the form of a helix. As described earlier, vertices 122, 142, 162 of routing structures 120, 140, 160 must be properly positioned with respect to the bottom ends of the deflection-edges; in the present embodiment, this positioning is established by the helical pitch of each deflection-edge.

FIG. 15 shows a side elevation view of deflector 500 installed in mounting-block 600. In the proper alignment of deflector 500, front mounting-edge 550 and front-surface 602 of mounting-block 600 are laterally aligned with the inner-surface of deflection-wall 60 at the bottom of input channel 70 (FIG. 5), and the common central axis of mounting-surface 510 and undersurfaces 520, 530, 540 coincides with the central axis of deflection-area 444. The radii of undersurfaces 520, 530, 540 are designed so that deflection-edges 560, 570, 580 are radially equidistant from deflection-area 444 at predetermined distances 564, 574, 584, respectively. The predetermined values of distances 564, 574, 584, are respectively equivalent to the predetermined values of heights 264, 274, 284, shown in FIG. 6.

In this embodiment, the sorting mechanism operates in the same manner described previously (FIG. 8). Coins of mixed denomination enter coin-chute 50 one at a time and roll edgewise toward deflector 500 in single file. The coins of the smallest diameter roll underneath deflector 500 into exit channel 110. Coins of each larger diameter are selectively engaged by one of the deflection-edges 560, 570, 580 and directed across deflection-area 444 into exit channels 130, 150, 170, respectively.

What is claimed is:

1. A mechanism for sorting coins, and other disk-shaped objects having different characteristic diameters, comprising:

(a) a base having an upper surface which is longitudinally inclined and nominally level in the lateral direction and which establishes a deflection-area that extends laterally across the central portion of said base, and (b) a coin-chute, deflection-wall, and collimation-wall which extend vertically upward from said upper surface and, in conjunction with said upper surface, form an input channel that extends longitudinally downward from the top of said base to the top of said deflection-area and is structured to collect deposited coins into a vertically-upright orientation and direct the edgewise rolling motion of these coins one at a time into said deflection-area, and (c) a plurality of routing structures which extend vertically upward from said upper surface and are shaped and laterally distributed across the bottom of said base in such a manner that the lateral separations between adjacent pairs of routing structures, in conjunction with said upper surface, form a plurality of exit channels each of which extending downward from distinct locations along the bottom of said deflection-area to distinct locations along the bottom of said base, and (d) a mounting-block which extends vertically upward from said upper surface at a location below the bottom end of said deflection-wall and laterally adjacent to said deflection-area and which is physically adapted to provide a means for installing a deflection element in proper operational alignment with said input channel, said deflection-area, and said plurality of exit channels, and (e) said deflection element having a set of lower surfaces structured to form a plurality of deflection-edges each of which being vertically tiered at different elevations and laterally curved through different predetermined angles which become progressively larger as the elevation of each deflection-edge increases, such that, when said deflection element is installed in said mounting-block, each deflection-edge is positioned at a predetermined height above said deflection-area so as to engage the topmost portion of coins having a particular diameter as they roll edgewise downward from said input channel into said deflection-area and redirect the rolling motion of these coins through a predetermined angle and guide their rolling motion across said deflection-area into a particular exit channel, in such a manner that coins of larger diameter are redirected through larger angles away from the downward longitudinal direction.

2. The mechanism of claim 1 wherein said input channel has a constricted width such that coins rolling edgewise down from said coin-chute in a side-by-side configuration are arrested within said input channel between said deflection-wall and said collimation-wall.

3. A method for sorting coins, and other disk-shaped objects having different characteristic diameters, comprising:

(a) providing a base having an upper surface which is longitudinally inclined and nominally level in the lateral direction and which establishes a deflection-area that extends laterally across the central portion of said base, and (b) providing a coin-chute, deflection-wall, and collimation-wall which extend vertically upward from said upper surface and, in conjunction with said upper surface, form an input channel that extends longitudinally downward from the top of said base to the top of said deflection-area and is structured to collect deposited coins into a vertically-upright orientation and direct the edgewise rolling motion of these coins one at a time into said deflection-area, and (c) providing a plurality of routing structures which extend vertically upward from said upper surface and are shaped and laterally distributed across the bottom of said base in such a manner that the lateral separations between adjacent pairs of routing structures, in conjunction with said upper surface, form a plurality of exit channels each of which extending downward from distinct locations along the bottom of said deflection-area to distinct locations along the bottom of said base, and (d) providing a mounting-block which extends vertically upward from said upper surface at a location below the bottom end of said deflection-wall and laterally adjacent to said deflection-area and which is physically adapted to provide a means for installing a deflection element in proper operational alignment with said input channel, said deflection-area, and said plurality of exit channels, and (e) providing said deflection element with a set of lower surfaces structured to form a plurality of deflection-edges each of which being vertically tiered at different elevations and laterally curved through different predetermined angles which become progressively larger as the elevation of each deflection-edge increases, such that, when said deflection element is installed in said mounting-block, each deflection-edge is positioned at a predetermined height above said deflection-area so as to engage the topmost portion of coins having a particular diameter as they roll edgewise downward from said input channel into said deflection-area and redirect the rolling motion of these coins through a predetermined angle and guide their rolling motion across said deflection-area into a particular exit channel, in such a manner that coins of larger diameter are redirected through larger angles away from the downward longitudinal direction, and (f) installing said deflection element in said mounting-block, and (g) depositing the coins to be sorted into said coin-chute.

4. The sorting method of claim 3 and providing said input channel with a constricted width such that coins rolling edgewise down from said coin-chute in a side-by-side configuration are arrested within said input channel between said deflection-wall and said collimation-wall.

* * * * *